US005082459A

United States Patent [19]

Billman et al.

[11] Patent Number: 5,082,459

[45] Date of Patent: Jan. 21, 1992

[54] DUAL READOUT SIMM SOCKET

[75] Inventors: Timothy B. Billman, King; Roger L. Thrush, Clemmons, both of N.C.

[73] Assignee: AMP Incorporated, Harrisburg, Pa.

[21] Appl. No.: 572,196

[22] Filed: Aug. 23, 1990

[51] Int. Cl.[5] ..... H01R 13/00

[52] U.S. Cl. ..... 439/637

[58] Field of Search ..... 439/629-637

[56] References Cited

U.S. PATENT DOCUMENTS

| | | | |
|---|---|---|---|
| 3,421,136 | 1/1969 | Bowley et al. | 439/637 |
| 3,422,394 | 1/1969 | Antes | 439/637 |
| 3,567,998 | 3/1971 | Ammerman | 317/101 |
| 3,631,381 | 12/1971 | Pittman | 439/637 |
| 4,275,944 | 6/1981 | Sochor | 439/636 |
| 4,850,891 | 7/1989 | Walkup et al. | 439/326 |
| 4,850,892 | 7/1989 | Clayton et al. | 439/636 |

OTHER PUBLICATIONS

AMP leaflet, 1986, "Fast Field Upgrade for Modular Memories".

AMP catalog B7-801, 9/87, "Micro-Edge SIMM Connectors".

AMP Supplement B7-798D-4/90. "SIMM II Right Angle Connectors".

Robinson Nugent Post Card entitled "SIMM Socket".

*Primary Examiner*—Joseph H. McGlynn

*Attorney, Agent, or Firm*—Allan B. Osborne

[57] ABSTRACT

A dual readout SIMM socket (10) has been disclosed. The socket (10) includes a housing (12) having panel receiving slots (14), terminal slots (16) transverse and open to panel slots (16) and terminals (13) positioned in the terminal slots (16). The terminals (13) include an S-shaped spring section extending outwardly from one edge (50) of a base section (44) with a depending arm (68) extending into the panel slot (16) for electrical engagement with traces on a circuit panel.

4 Claims, 5 Drawing Sheets

DUAL READOUT SIMM SOCKET

FIELD OF THE INVENTION

This application relates to an electrical connector or socket for use with circuit panels on which single-in-line memory modules (SIMM) are mounted to interconnect circuits thereon to circuits on a substrate.

BACKGROUND OF THE INVENTION

Single in-line memory modules; i.e. "SIMM", represent a high density, low profile single in-line package for electronic components such as dynamic random access memory integrated circuit components. A plurality of these components can be mounted in line on a circuit panel whose height is little more than the length of the components themselves. The circuit panels can in turn be mounted on a printed circuit board daughtercard which can then be mounted on a printed circuit board mothercard. The spacing between adjacent daughtercards would then need to be only slightly greater than the height of the individual circuit panels or single in-line memory modules.

Hereto before circuit panels have been used in which the circuit traces on one side or surface are duplicated and electrically connected to traces on the opposite surface with the traces on both surfaces being in direct alignment with each other. Accordingly the sockets, known as "SIMM" sockets, such as disclosed in U.S. Pat. No. 4,973,270 have terminals which include opposed beams commoned to a single lead to provide redundant electrical engagement to each of the two commoned traces, one on each surface on the panel.

In response to industry's needs, we now propose to electrically isolate circuits and traces on opposite surfaces of the circuit panel so that additional electronic components can be mounted thereon and to provide a SIMM socket having electrically separate terminals on both sides of the panel receiving slot to engage the traces on both surfaces.

SUMMARY OF THE INVENTION

According to the present invention, a dual readout SIMM socket is provided for establishing independent electrical circuit traces on opposite sides of a circuit panel. The socket includes a housing having a panel receiving slot and independent terminals on each side of the slot having a contact point extending into the slot for engaging the circuit traces.

DESCRIPTION OF THE INVENTION

Figure 1:
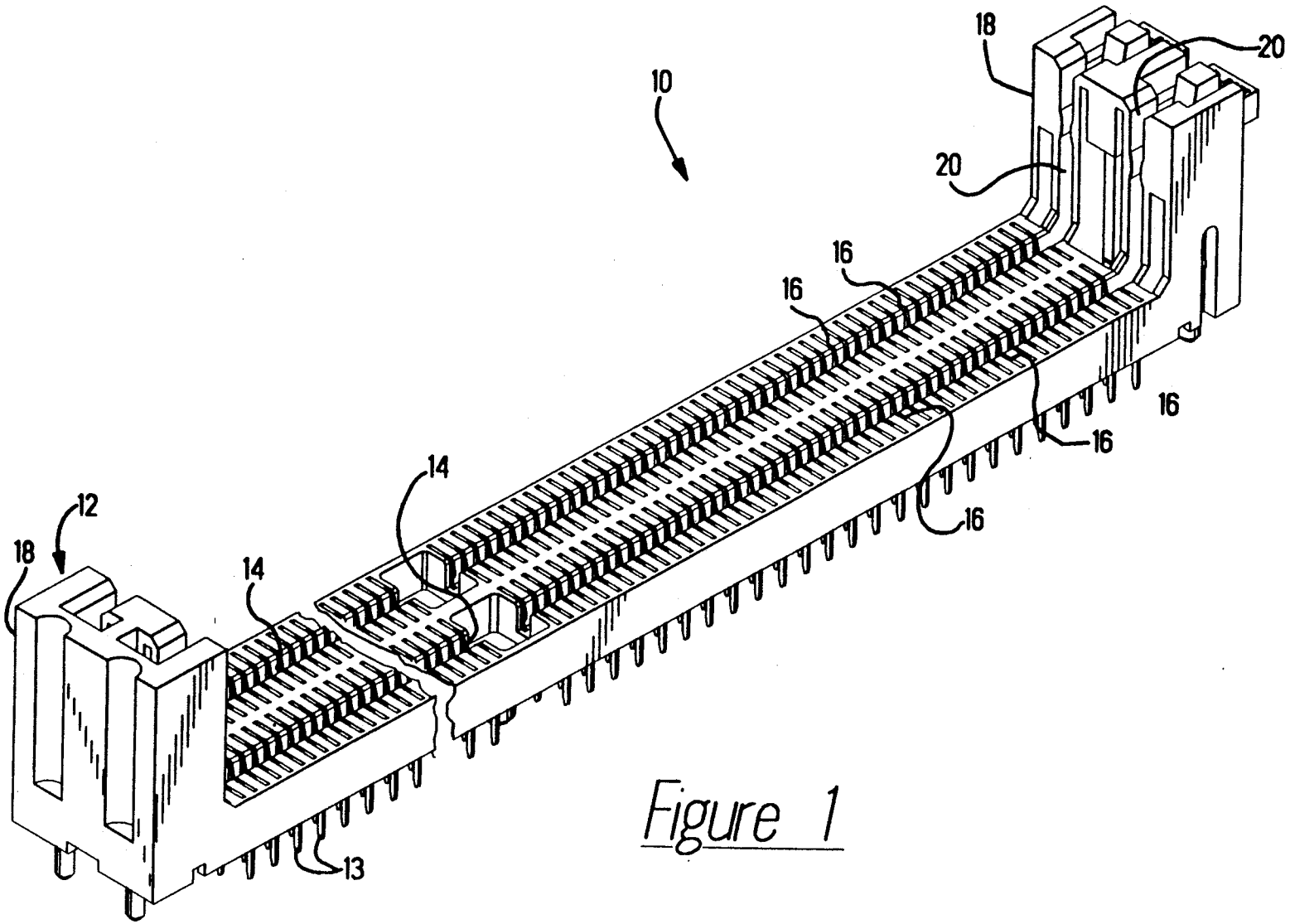
FIG. 1 is a perspective view of the dual readout SIMM socket of the present invention.
Figure 2:
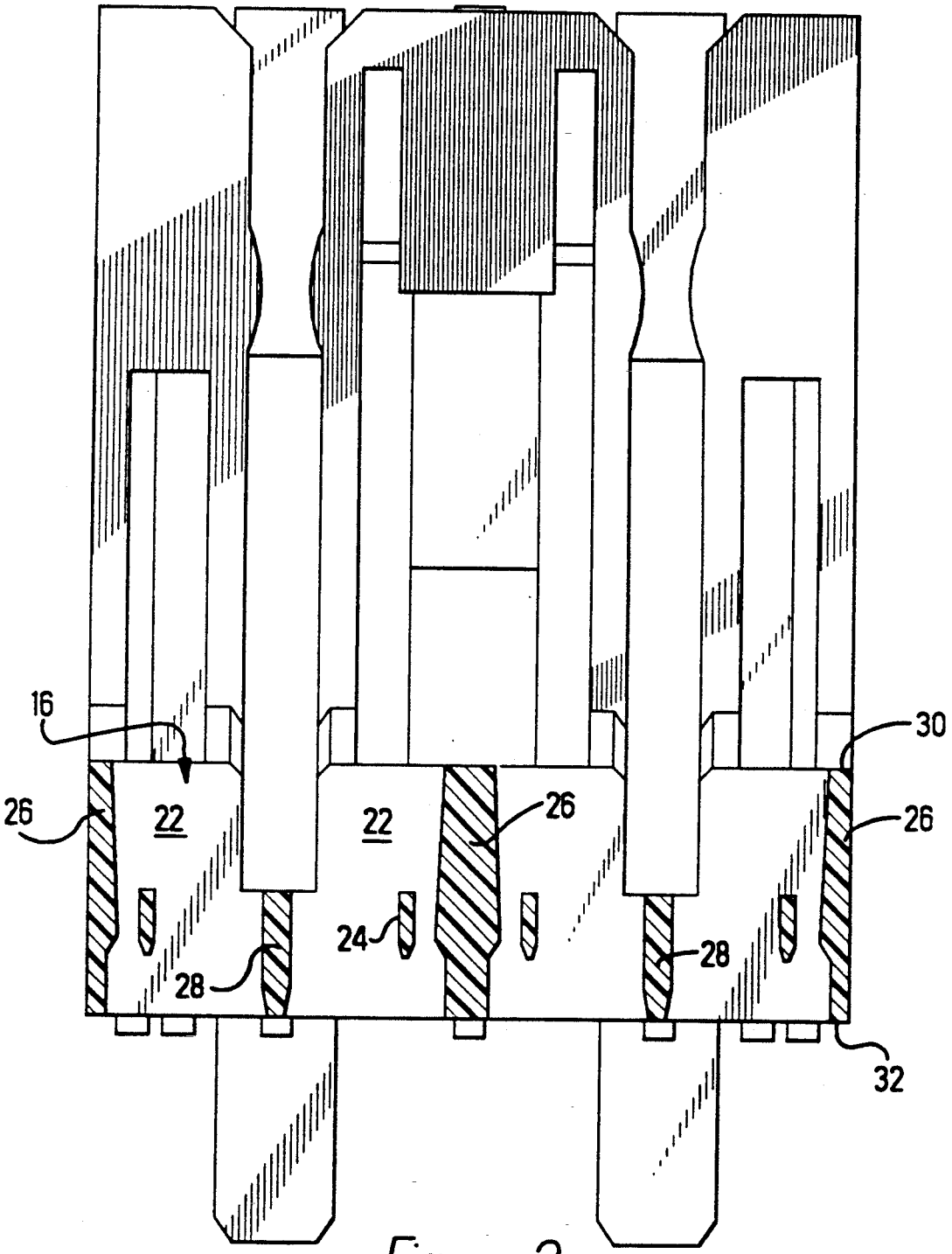
FIG. 2 is a sectioned end view of the socket.
Figure 4:
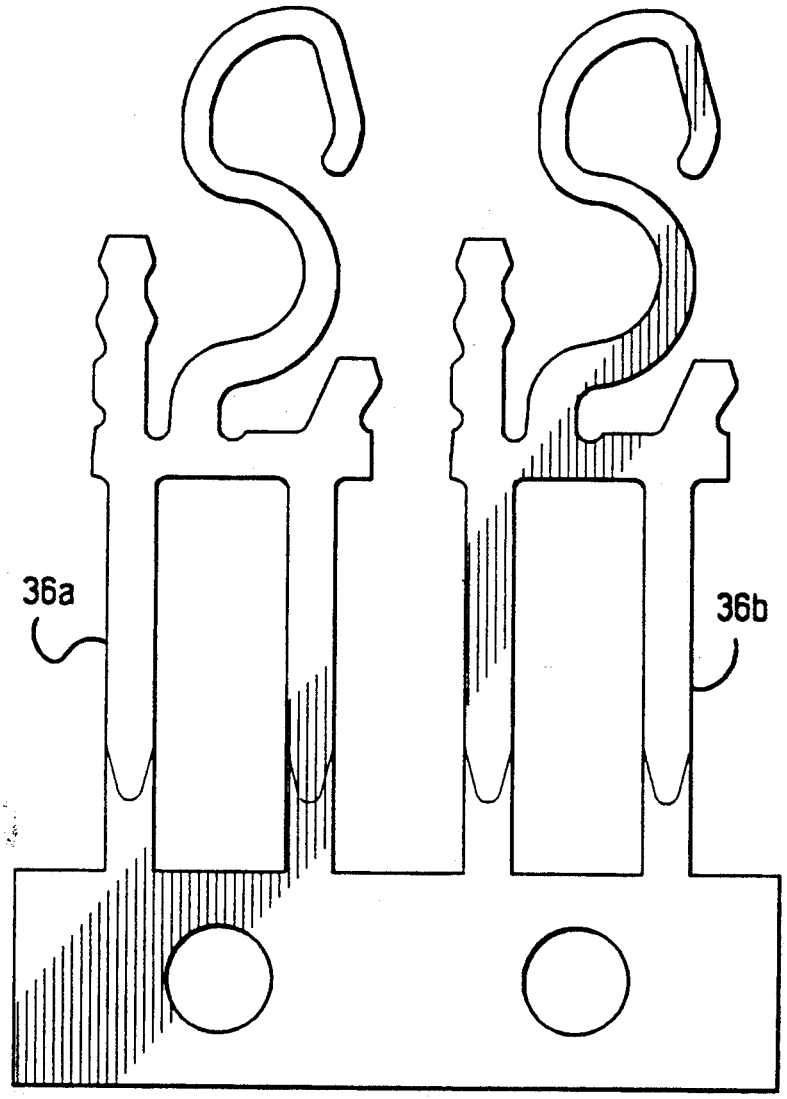
FIG. 4 is a side plan view of the terminals used in the socket.
Figure 5:
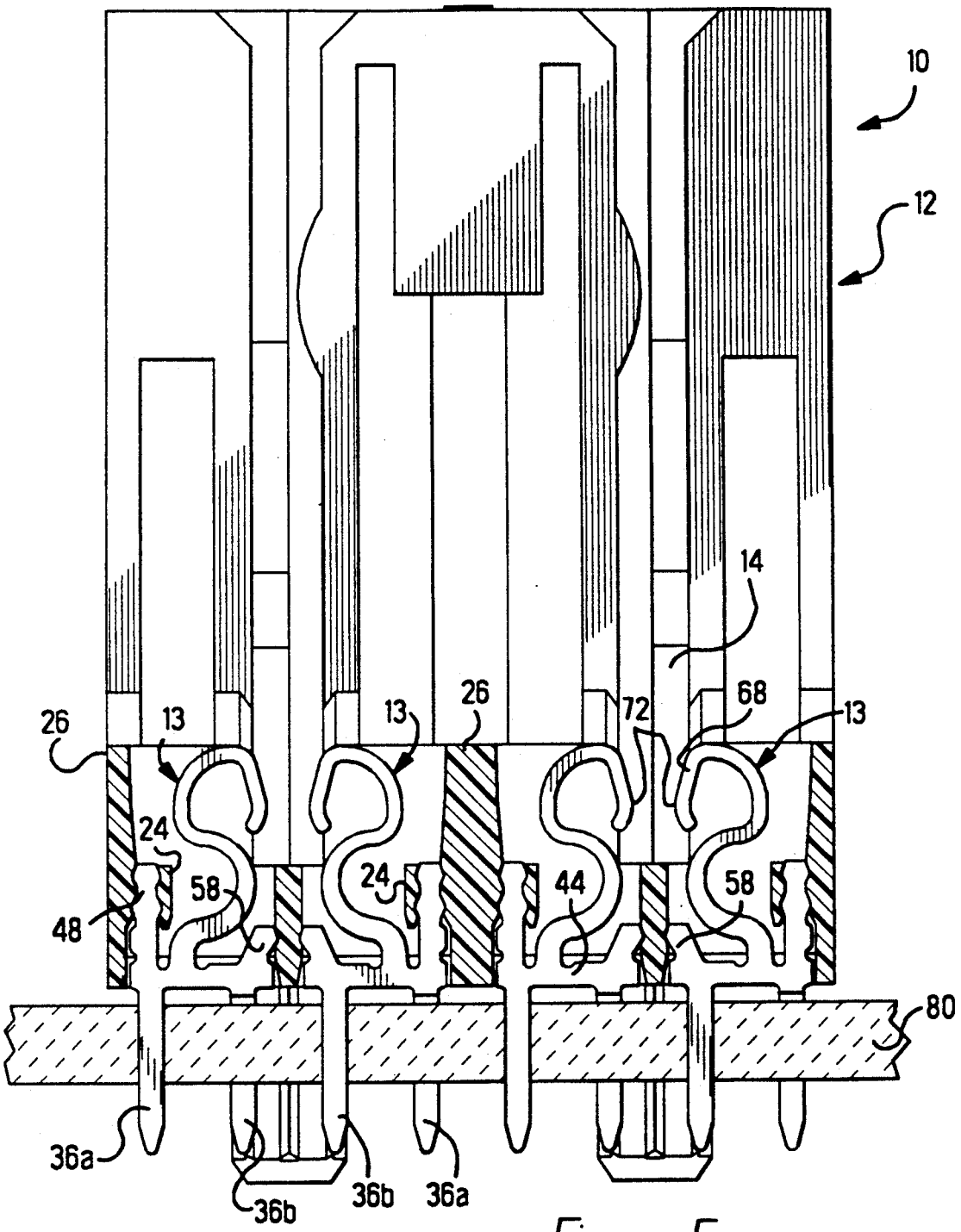
FIG. 5 is a sectioned end view of the sockets with the terminals therein.

The dual readout SIMM socket 10 shown in FIG. 1 includes housing 12 and a plurality of terminals 13 shown in FIGS. 2, 4 and 5.

Housing 12, preferably molded from a suitable plastics material such as a liquid crystal polymer, includes two parallel panel slots 14, a plurality of terminal slots 16 which are normal to and open into panel slots 14, and at respective ends, panel support members 18. Grooves 20 in members 18 receive and retain SIMM panels (not shown).

As shown in FIG. 2, terminal slots 16 are defined by transverse walls 22 which serve to isolate adjacent terminals 13 and which support retaining bars 24 extending therebetween. Bars 24 are parallel to and spaced in from sidewalls 26 and centerwall 28. Slots 16 are open onto top surface 30 and bottom surface 32 as well as into respective panel slots 14.

Figure 3:
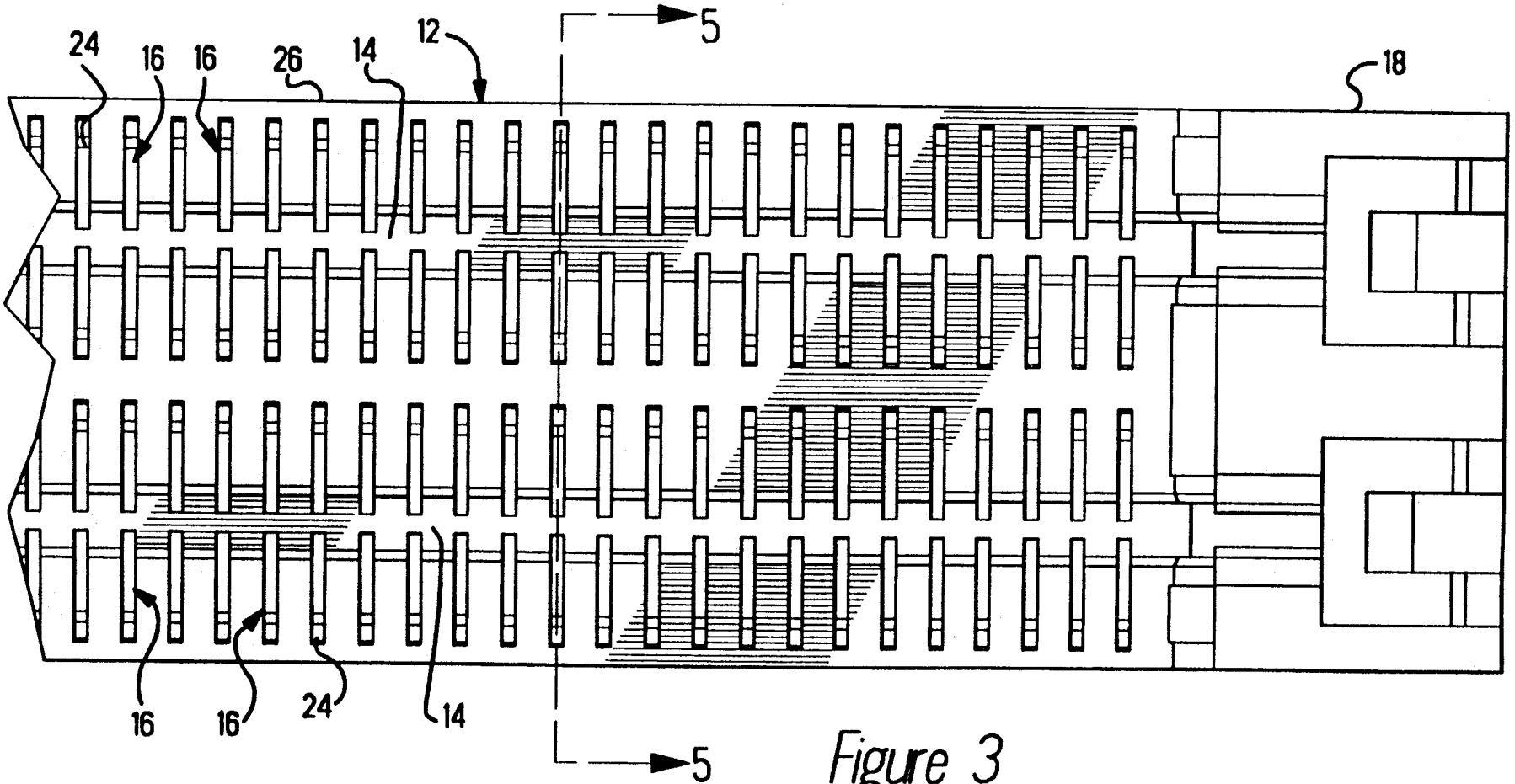
FIG. 3 is a top plan view of the socket.

As shown in FIG. 3, terminal slots 16 face each other on opposite sides of panel slots 14. In the embodiment illustrated, adjacent terminal slots 16 are on a 0.050 inch center line spacing although other spacings; e.g., 0.025 inch, may be used.

FIG. 4 shows one embodiment of terminal 13 on carrier strip 34 with the preferred method of manufacture being by stamping and forming from strips of coplanar stock of phosphor bronze (not shown) other suitable conductive materials may also be used. Each terminal 13 includes lead **36*a* or 36*b* attached to and extending away from edge 38 and at either end 40 or 42 of base section 44**.

First retention post 48 extends away from opposite base edge 50 at end 40. Post 48 is provided with barbs 52.

Second retention post 58 extends away from opposite base edge 50 at end 42. Post 58 includes a barb 60 on outside edge 62.

Spring section 64 extends outwardly from its attachment to base edge 50 and is located just inwardly from first retention post 48. Spring section 64 is S-shaped and carries at free end 66 depending arm 68. Arm 68 at its free end 70 bends slightly back towards section 64 and includes contact point 72 on edge 74.

As shown in FIG. 5, it can be seen that terminals 13 are retained in slots 16 by first retention post 48 and particularly barbs 52 being frictionally received in the space defined by sidewalls 26 and associated bars 24. Further retention is provided by second retention post 58 being forced against centerwall 28; i.e., the width of slot 16 is slightly less than the length of base section 44. Depending arm 68 extends into panel slot 14 with contact point 72 being most inwardly.

FIG. 5 also shows socket 10 mounted on substrate 80 which may be a back plane, printed circuit board or other like devices. During loading a pair of terminals 13, as shown in FIG. 4, are partially inserted into slots 16 from below and carrier strip 34 severed therefrom. Further, the contination of base section 44 which extends between paired terminals 13, indicated by reference numeral **44*a* in FIG. 4, is cut away to separate the terminals 13. As can be seen from the drawing, terminals 13 in adjacent slots 16 will have either lead 36*a* or 36*b*. Terminals 13 in slots 16 across panel slot 14 will have an opposite lead 36*a*, 36*b*. Thus, as shown, the left-hand terminal 13 has lead 36*a* depending therefrom while the right-hand terminal 13 has lead 36*b* depending therefrom. Leads 36 are inserted and soldered in holes 82 in substrate 80 in a manner well known in the industry. In lieu of leads 36, terminals 13** may have surface mount legs (not shown) or other means for establishing electrical contact with the substrate.

In use, traces on opposite sides of a circuit panel (not shown) inserted into panel slot 14 engage opposite and electrically isolated contact points 72 and are electrically interconnected to circuits (not shown) on substrate 80.

Socket 10 has been illustrated as having two parallel panel slots 14. Obviously socket 10 may be modified to include only a single slot 14.

The ability to staggered leads 36 reflect the hole pattern on substrate 80. Obviously other patterns may require other staggered arrangements than shown.

As can be discerned, a dual readout SIMM socket has been disclosed. The socket includes one or more panel slots and transverse thereto a plurality of terminal slots. The terminals positioned in the slots include a S-shaped spring section from which an arm having a contact point depends. Retention members, one at each end of a base section, retain the terminal in the slot with leads extending outwardly from the housing for insertion into holes in the substrate. The contact points on the depending arms extend into the panel slot to resiliently and electrically engage conductive traces on opposite surfaces of a panel inserted into the panel slot.

We claim:

1. A dual readout SIMM socket for establishing electrical contact with electrical isolated circuit traces on no more than 0.050 inch center-line spacing on opposite surfaces of a single in line memory module, said socket comprising:

a housing having a module receiving slot extending between and into module-retaining grooves at each end of said housing and terminal receiving slots normal to and intersecting said module receiving slot on both sides thereof; and a plurality of terminals disposed in said terminal receiving slots and having a S-shaped spring section with a trace engaging contact point on a depending arm extending into said module receiving slot, a base section having an upper edge from which said spring section extends, a lower edge from which a lead extends, a retaining post at one end extending outwardly parallel and adjacent to a side wall and having retaining barbs thereon for engaging said side wall and a stabilizing post at another end which extends obliquely outwardly therefrom for engaging a center rib of said housing.

2. The socket of claim 1 wherein said terminals are edge stamped.

3. The socket of claim 1 wherein said spring section decreases in width from said base section for providing stress relief on said spring section when engaging a module.

4. The socket of claim 1 wherein said housing includes a panel support member on each end thereof with said module-retaining grooves therein.

* * * * *